US007439932B2

(12) United States Patent
Lin

(10) Patent No.: US 7,439,932 B2
(45) Date of Patent: Oct. 21, 2008

(54) ANTENNA MOUNTING BRACKET

(75) Inventor: Tzu-Yu Lin, Shulin (TW)

(73) Assignee: Shin Zu Shing Co., Ltd., Shulin, Taipei Hsien (TW)

( * ) Notice: Subject to any disclaimer, the term of this patent is extended or adjusted under 35 U.S.C. 154(b) by 92 days.

(21) Appl. No.: 11/706,234

(22) Filed: Feb. 15, 2007

(65) Prior Publication Data

US 2008/0198092 A1 Aug. 21, 2008

(51) Int. Cl.
*H01Q 3/02* (2006.01)
*H01Q 1/24* (2006.01)
*H01Q 1/08* (2006.01)
*H01Q 1/12* (2006.01)

(52) U.S. Cl. ..... 343/882; 343/702; 343/880; 343/892; 343/878

(58) Field of Classification Search ..... 343/882, 343/702, 880, 892, 878; 248/346.04, 536, 248/539, 534, 560
See application file for complete search history.

(56) References Cited

U.S. PATENT DOCUMENTS 5,422,651 A * 6/1995 Chang ..... 343/749
6,115,886 A * 9/2000 Fujita ..... 16/330
6,215,445 B1 * 4/2001 Chang ..... 343/702
6,518,928 B1 * 2/2003 Sheu ..... 343/702
6,639,562 B2 * 10/2003 Suganthan et al. ..... 343/702
7,046,212 B2 * 5/2006 Tai et al. ..... 343/882
7,233,292 B2 * 6/2007 Chan ..... 343/702
2004/0257299 A1 * 12/2004 Tai et al. ..... 343/906
2005/0093762 A1 * 5/2005 Pick ..... 343/878
2005/0116877 A1 * 6/2005 Wu ..... 343/882
2006/0273980 A1 * 12/2006 Chan ..... 343/906
2007/0085756 A1 * 4/2007 Chan ..... 343/906
2007/0182661 A1 * 8/2007 Haynes et al. ..... 343/878

* cited by examiner

*Primary Examiner*—Douglas W. Owens
*Assistant Examiner*—Jennifer F Chang
(74) *Attorney, Agent, or Firm*—Bacon & Thomas, PLLC

(57) ABSTRACT

An antenna mounting bracket has a stationary leaf, a housing, a sliding plug and a spring. The stationary leaf has a connecting rod formed coaxially on and protruding from the stationary leaf. The housing is connected pivotally on the stationary leaf and has a proximal end, a distal end, a cavity formed coaxially in the proximal end and has a connecting leaf formed coaxially on and protruding from the distal end and attaching to an antenna. The sliding plug is mounted slidably in the cavity and presses against the connecting rod. The spring is mounted in the cavity between the housing and the sliding plug to press the sliding plug against the connecting rod. The antenna mounting bracket connects an antenna to a notebook computer and allows the antenna to fold against the notebook computer when not being used. Consequently, the antenna is stable when folded or extended.

5 Claims, 7 Drawing Sheets

ANTENNA MOUNTING BRACKET

BACKGROUND OF THE INVENTION

1. Field of the Invention

The present invention relates to a mounting bracket, especially to an antenna mounting bracket to connect an antenna to a notebook computer and be able to fold the antenna against the notebook computer.

2. Description of the Prior Arts

Because of recent developments with the Internet and equipment used on the Internet, the Internet is not limited to transferring data. To make using notebook computers more convenient, many mainstream notebook computers are equipped with built-in wireless network-cards to allow the notebook computers to connect to the Internet. The antenna is usually mounted pivotally on a wireless network-card or a notebook computer casing and is connected to the built-in network card through an internal circuit. However, conventional antennas do not include a device that will hold the antennas in position and easily move when shaken or bumped accidentally. That can be inconvenient to a user when operating, carrying or moving the notebook computer.

To overcome the shortcomings, the present invention provides an antenna mounting bracket to mitigate or obviate the aforementioned problems.

SUMMARY OF THE INVENTION

The main objective of the present invention is to provide an antenna mounting bracket that will hold an antenna attached to a notebook computer stably in position. The antenna mounting bracket in accordance with the present invention comprises a stationary leaf, a housing, a sliding plug and a spring. The stationary leaf has a connecting rod formed coaxially on and protruding from the stationary leaf. The housing is connected pivotally to the stationary leaf and has a proximal end, a distal end, a cavity and a connecting leaf. The cavity is formed coaxially in the proximal end. The connecting leaf is formed coaxially on and protrudes from the distal end and attaches to an antenna. The sliding plug is mounted slidably in the cavity and presses against the connecting rod. The spring is mounted in the cavity between the housing and the sliding plug to press the sliding plug against the connecting rod and hold the housing in position.

The antenna mounting bracket as described connects an antenna to a notebook computer and allows the antenna to fold against the notebook computer when not being used. Consequently, the antenna is stable when folded or extended on a notebook computer.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
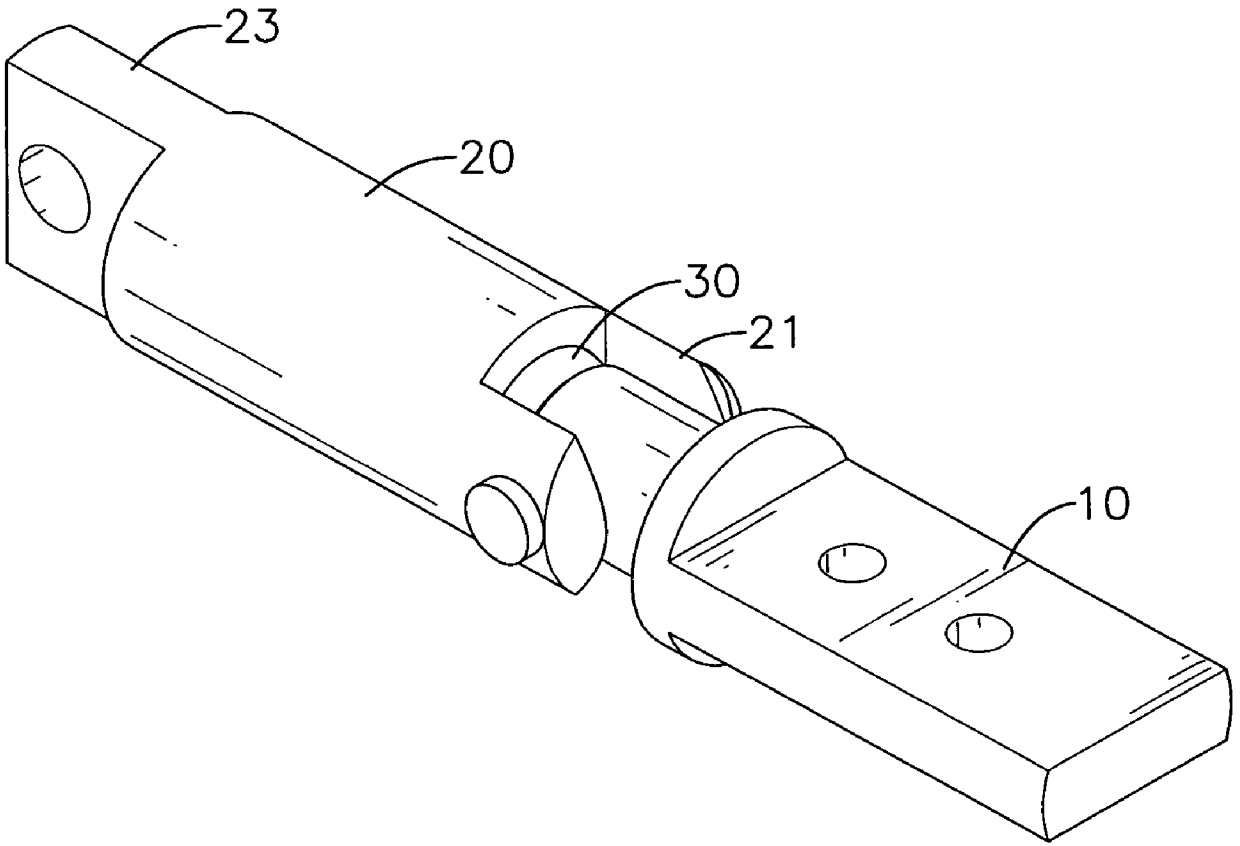
FIG. 1 is a perspective view of an antenna mounting bracket in accordance with the present invention.
Figure 2:
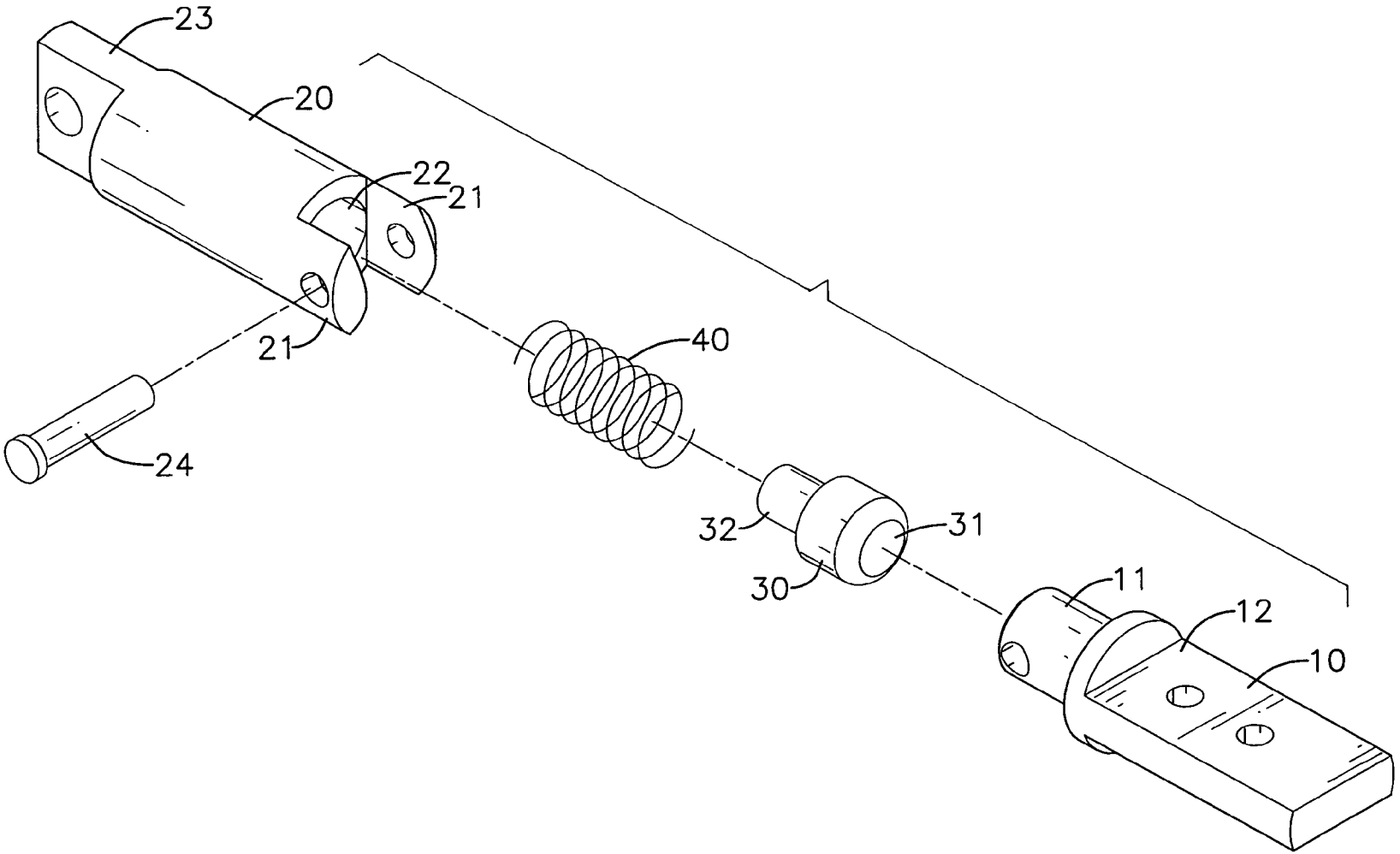
FIG. 2 is an exploded perspective view of the antenna mounting bracket in FIG. 1.

With reference to FIGS. 1 and 2, an antenna mounting bracket in accordance with the present intention comprises a stationary leaf (10), a housing (20), a sliding plug (30) and a spring (40).

Figure 3:
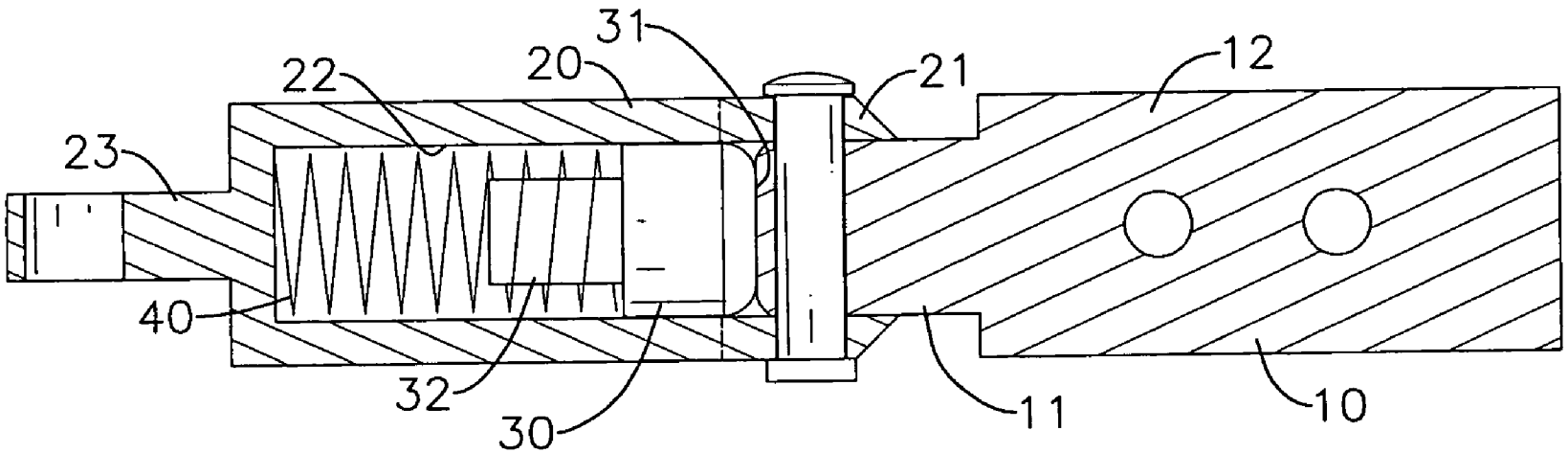
FIG. 3 is a side view in partial section of the antenna mounting bracket in FIG. 1.
Figure 4:
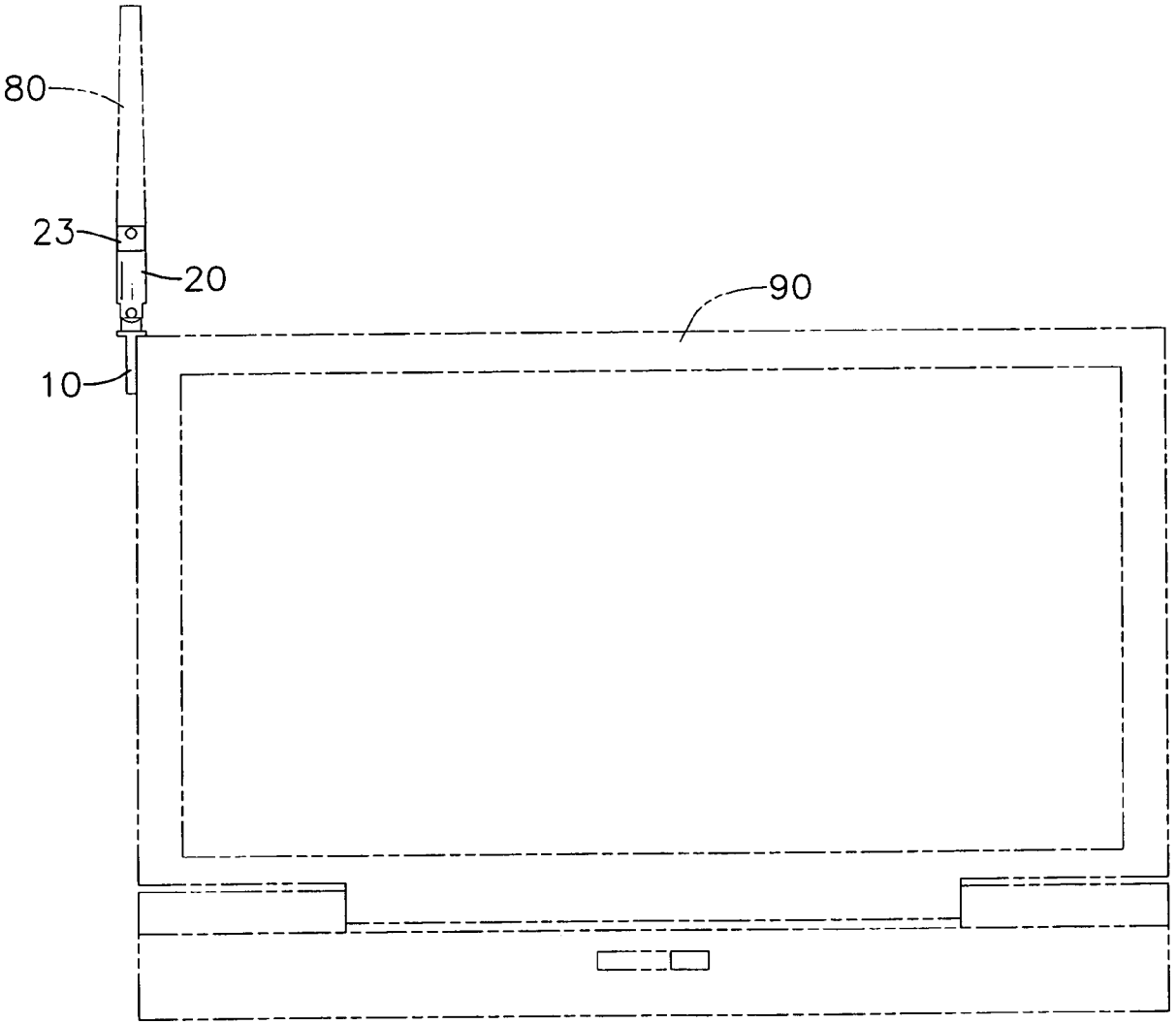
FIG. 4 is an operational side view of the antenna mounting bracket in FIG. 1 with an antenna attached and mounted on a notebook computer.
Figure 5:
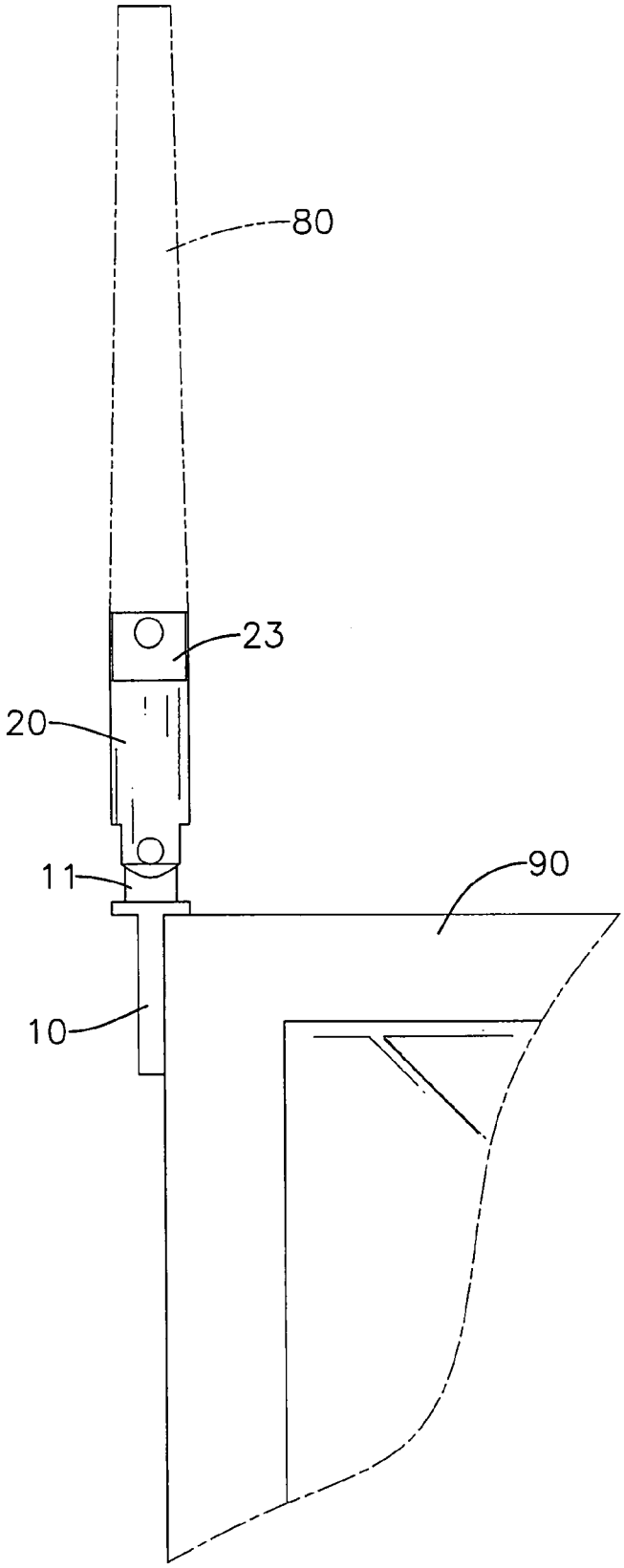
FIG. 5 is an enlarged side view of the antenna mounting bracket in FIG. 4.

With further reference to FIGS. 3, 4 and 5, the stationary leaf (10) has a proximal end, a distal end, a fastening leaf (12) and a connecting rod (11). The fastening leaf (12) is formed at the proximal end and attaches to a notebook computer (90). The connecting rod (11) is formed on and extends coaxially from the distal end and has an optional pivot hole, an end surface and an outside wall. The pivot hole is formed transversely through the connecting rod (11). The end surface is flat. The outside wall is perpendicular to the end surface.

Figure 6:
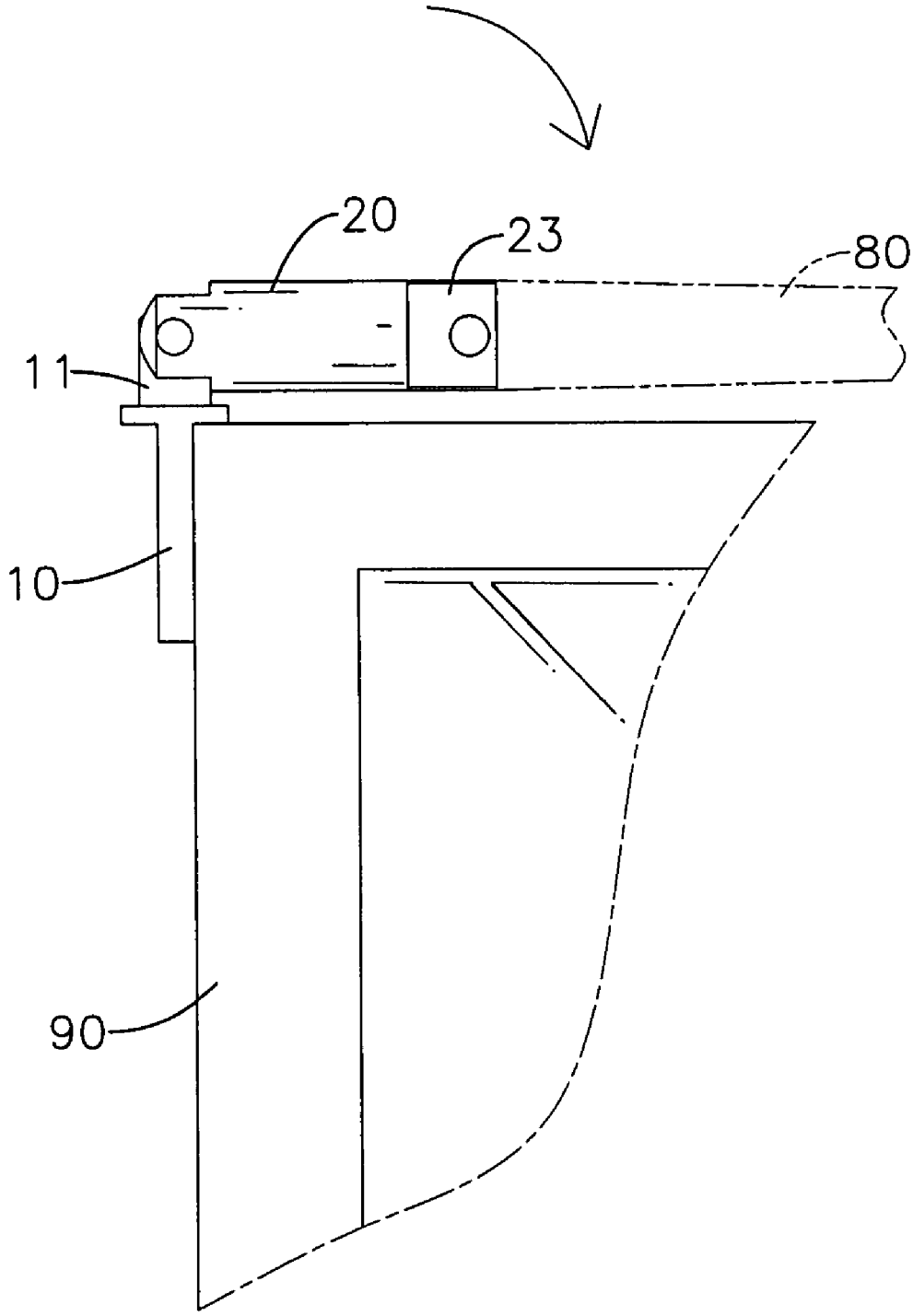
FIG. 6 is an operation side view of the antenna mounting bracket in FIG. 4 with the antenna pivoted 90° against the notebook computer.
Figure 7:
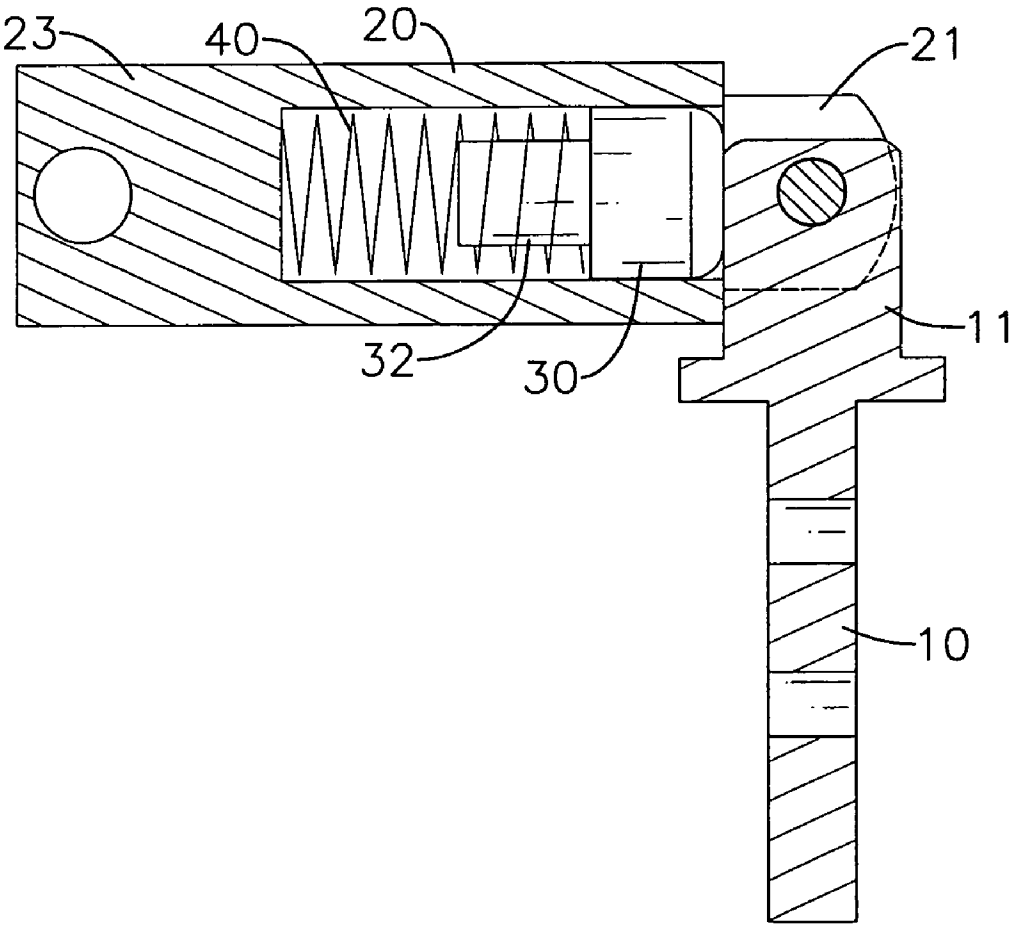
FIG. 7 is an operational side view in partial section of the antenna mounting bracket in FIG. 6.

With further reference to FIGS. 6 and 7, the housing (20) is connected pivotally to the connecting rod (11) of the stationary leaf (10), allows an antenna (80) to extend away from a notebook computer (90) or fold against a notebook computer (90) and has a proximal end, a distal end, two optional ears (21), an optional pivot pin (24), a cavity (22) and a connecting leaf (23). The two ears (21) are formed diametrically opposite to each other and protrude longitudinally from the proximal end of the housing (20) and attach pivotally to the connecting rod (11), and each ear (21) may have a mounting hole. The mounting holes in the ears (21) are aligned with each other and align with the pivot hole in the connecting rod (11). The pivot pin (24) is mounted through the mounting holes in the ears (21) and the pivot hole in the connecting rod (11) to allow the housing (20) to pivot on the connecting rod (11). The cavity (22) is formed coaxially in the proximal end of the housing (20) and has an inner end. The connecting leaf (23) is formed coaxially on and protrudes from the distal end of the housing (20) and attaches to and securely holds an antenna (80).

The sliding plug (30) is mounted movably in the cavity (22), abuts the connecting rod (11) and has an outer end (31), an inner end and a rod (32). The outer end (31) is flat, abuts the connecting rod (11) and has an optional annular inclined edge. When the antenna (80) is folded against a notebook computer (90) in a stored position, the outer end (31) of the sliding plug (30) presses against the outside wall of the connecting rod (11). When the antenna (80) extends away from a notebook computer (90), the outer end (31) of the sliding plug (30) presses against the end surface of the connecting rod (11) or the outside wall of the connecting rod (1) opposite to the stored position. The rod (32) is formed coaxially on and protrudes from the inner end.

The spring (40) is mounted in the cavity (22) around the rod (32) of the sliding plug (30) between the inner end of the sliding plug (30) and the inner end of the cavity (22) and presses the sliding plug (30) against the connecting rod (11).

The antenna mounting bracket as described connects an antenna (80) to a notebook computer (90) and allows the antenna (80) to fold against the notebook computer (90) when not being used. Moreover, the flat outer end (31) of the sliding plug (30) and the spring (40) pressing the sliding plug (30)

against the connecting rod (11) cause an antenna (80) to hold stably in position when folded or extended on a notebook computer (90).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An antenna mounting bracket comprising:

a stationary leaf having a proximal end;

a distal end;

a fastening leaf being formed at the proximal end; and a connecting rod being formed on and extending coaxially from the distal end and having an end surface; and an outside wall;

a housing being connected pivotally to the connecting rod of the stationary leaf and having a proximal end;

a distal end;

a cavity being formed in the proximal end of the housing and having an inner end; and a connecting leaf being formed coaxially on and protruding from the distal end of the housing;

a sliding plug being mounted movably in the cavity, abutting the connecting rod of the stationary leaf and having an outer end;

an inner end abutting the connecting rod; and a rod being formed coaxially on and protruding from the inner end of the sliding plug; and a spring being mounted in the cavity around the rod of the sliding plug between the inner end of the sliding plug and the inner end of the cavity and pressing the sliding plug against the connecting rod.

2. The antenna mounting bracket as claimed in claim 1, wherein the end surface of the connecting rod of the stationary leaf is flat;

the outside wall of the connecting rod of the stationary leaf is perpendicular to the end surface of the connecting rod of the stationary leaf; and the inner end of the sliding plug is flat.

3. The antenna mounting bracket as claimed 1, wherein the housing further has two ears formed diametrically opposite to each other and protruding longitudinally from the proximal end of the housing and attaching pivotally to the connecting rod of the stationary leaf.

4. The antenna mounting bracket as claimed 1, wherein the outer end of the sliding plug has an annular inclined edge.

5. The antenna mounting bracket as claimed 3, wherein the connecting rod further has a pivot hole formed transversely through the connecting rod;

each ear on the housing has a mounting hole, the mounting holes being aligned with each other and aligning with the pivot hole in the connecting rod;

the housing further has a pivot pin mounted through the mounting holes in the ears and the pivot hole in the connecting rod.

* * * * *